United States Patent [19]

Drexhage

[11] Patent Number: 4,901,911

[45] Date of Patent: Feb. 20, 1990

[54] FOLDABLE CARTON

[76] Inventor: Gerrit K. Drexhage, P.O. Box 349, Cazadero, Calif. 95421

[21] Appl. No.: 240,513

[22] Filed: Sep. 6, 1988

[51] Int. Cl.[4] ..... B65D 5/54

[52] U.S. Cl. ..... 229/114; 229/160; 229/169; 229/186

[58] Field of Search ..... 229/114, 154, 137, 160, 229/186, 125.35, 169

[56] References Cited

U.S. PATENT DOCUMENTS

| | | | |
|---|---|---|---|
| 688,114 | 12/1901 | Plester | 229/137 |
| 1,035,638 | 8/1912 | Reber | 229/169 |
| 1,063,488 | 6/1913 | Wilson | 229/160 |
| 2,316,261 | 4/1943 | Levkoff | 229/160 |
| 2,912,153 | 11/1959 | Lange | 229/137 |
| 2,917,221 | 12/1959 | Risdon . | |
| 3,316,102 | 4/1967 | Doll et al. . | |
| 3,572,576 | 3/1971 | Foster | 229/160 |
| 3,581,977 | 6/1971 | Kirsky et al. . | |
| 3,655,115 | 4/1972 | Manizza . | |
| 3,750,932 | 8/1973 | Ellison . | |
| 3,780,932 | 12/1973 | McLaren et al. . | |
| 3,829,003 | 8/1974 | Dilot . | |
| 3,905,544 | 9/1975 | Tipton | 229/169 |
| 3,913,823 | 10/1975 | Lin . | |
| 3,964,668 | 6/1976 | Lin . | |
| 4,036,423 | 7/1977 | Gordon . | |
| 4,184,597 | 1/1980 | Gavin . | |
| 4,216,861 | 8/1980 | Oliff . | |
| 4,344,537 | 8/1982 | Austin . | |
| 4,586,648 | 5/1986 | Josefsson et al. . | |
| 4,586,649 | 5/1986 | Webinger . | |
| 4,687,104 | 8/1987 | Ielmini . | |
| 4,687,130 | 8/1987 | Beeler . | |

FOREIGN PATENT DOCUMENTS 2612892 10/1976 Fed. Rep. of Germany ..... 125/26

*Primary Examiner*—Stephen Marcus
*Assistant Examiner*—Jes F. Pascua
*Attorney, Agent, or Firm*—Flehr, Hohbach, Test, Albritton & Herbert

[57] ABSTRACT

A foldable carton for various products which is particularly suitable for storing, microwave cooking and serving of food products. The carton is formed from a one-piece paperboard sheet having a polygonal bottom panel, plurality of side and end panels foldably joined to the edges of the bottom panel and extending completely around the periphery of the bottom panel. Side web assemblies foldably join the side and end panels together in a continuous band and include fold lines positioned to elevate the side and end panels with respect to the bottom to provide a liquid impervious tray. The carton further includes extension panels foldably joined to an outer periphery of the side and end panels, together with extension web assemblies that also form a continuous band completely encircling the outer periphery of the side and end panels. Relief openings are provided in the carton between the side web assemblies and the extension web assemblies in order to permit folding of the extension web panels to and from a vertical position and a position parallel to the bottom panel. The carton further preferably includes a top panel assembly which can be removed by the user to permit the extension panels to be popped up as a unit to provide a mixing and spatter shield, as well as to provide access to the contents of the carton. A set-up carton employing the invention also is disclosed.

23 Claims, 6 Drawing Sheets

FOLDABLE CARTON

TECHNICAL FIELD

The present invention relates, in general, to folded cartons, and more particularly, the invention relates to a one-piece foldable tray-like carton which may be used as a container for a wide variety of products and is particularly well suited for storage, microwave cooking and serving of food products.

BACKGROUND ART

The use of microwave ovens in home cooking has been steadily increasing. It has become highly desirable, therefore, to package food products, and particularly shelf-stable and frozen food products, in containers or cartons which are suitable for heating or cooking of the food in the carton. Moreover, it is highly desirable if the carton may optionally be used as a mixing and serving dish.

As is the case in general with packaging, it is also a very important aspect of any container that the cost of the container be minimized. Thus, cartons for food and non-food products which require expensive or costly equipment to effect folding or folding cycle times which are relatively long will result in an undesirably high carton cost. Similarly, cartons which are formed from separate components and/or inserts that are adhesively secured together usually are undesirably costly to manufacture.

A standard approach to the formation of cartons is to provide flaps or tabs which can be used in combination with various fold lines to secure the sides and top of a carton together. The technique of using tabs or flaps to form a carton, however, requires that the sidewalls and bottom of the carton be held in an indexed or squared relationship during the process of adhesively securing the tabs or flaps in place. Such indexing can be accomplished, but it also increases the cycle time for formation of a carton from a carton blank. This same component indexing problem occurs when cartons are formed from two or more pieces that are adhesively secured together.

Typical of a prior art foldable microwave carton is the carton shown in U.S. Pat. No. 4,687,104. The carton is formed from a one-piece blank in which the bottom and sidewalls are folded up while the top with associated flaps are folded down to form the carton. The top also includes a reverse cut flap which can be opened to allow the user to eat food directly from the carton. The carton is constructed, however, so that upon opening of the reverse cut flap there remains a U-shaped lip around the top of the carton, which provides structural integrity, but also inhibits eating directly from the carton. Moreover, the level of food in the carton will normally be substantially at the level of the opening. Thus, adding ingredients to such cartons, using the carton as a mixing container, and cooking with the top removed and without spatter from the carton, is not practical.

U.S. Pat. No. 4,586,648 discloses a tray-like carton in which the sidewalls of the carton include a tapered section and an upwardly extending lip or skirt section. This carton is formed from a single piece blank, but the upper carton extension is secured through the use of flaps which are adhesively joined to the extension panels, which requires indexing or folding of the carton while held in the square relationship. Moreover, the extension on the tray-like carton always remains in an extended position and a lid is mounted to the top of the carton. While a carton of this type provides greater access to its contents, if the carton is filled to the top of the extension, cooking with the top off and without spatter is not possible, and spilling from the carton when it is used as a serving tray or dish is not unlikely.

U.S. Pat. No. 2,917,221 discloses a foldable carton or container having sidewalls and an extension which can be folded between an extended position above the side wall panels and an inwardly folded position generally parallel to the bottom panel. Again, however, the carton is die cut so that the end walls of the carton are free flaps which must be held in a squared-up relationship during carton forming. Additionally, die cuts extend completely to the bottom wall of the carton, making the carton poorly suited for use with food products containing liquids, which can leak from the corners of the carton.

A similar carton structure is shown in U.S. Pat. No. 3,581,977, but folding and formation of the carton is accomplished by reducing the number of seams at which leakage can occur to one. This, again, requires squaring-up of the carton during the tab sealing process, and the carton still contains one vertically extending seam which can be the source of leakage. Other tray-like cartons are disclosed in U.S. Pat. Nos. 3,316,102; 3,829,003 and 4,344,537. Generally, these foldable cartons lack a skirt above the sidewalls which will permit the adding of ingredients, allow mixing in the carton and prevent spilling of the contents during eating directly from the carton. Formation of such cartons also may depend upon holding the carton in a square relationship during the folding process so that free tab ends can be adhesively secured in the proper position.

Other foldable cartons which depend upon squaring-up and holding of the carton walls in position during the sealing of flaps in place are disclosed in U.S. Pat. Nos. 3,655,155; 3,750,932; 3,780,932; 3,913,823; 3,964,668; 4,036,423; 4,184,597; 4,586,649 and 4,687,130. Finally, U.S. Pat. No. 4,216,861 discloses a folded tubular carton in which an opening is employed to provide a structure for locking end flaps in place to avoid the necessity of gluing. This carton, however, is not suitable for use as a serving tray, does not include an extension to prevent the spilling of contents, and the openings in the carton walls are positioned so as to be a potential source of leaks in the event that liquids were to be heated in the carton.

Accordingly, it is an object of the present invention to provide a foldable carton which is suitable for use for storing a variety of food and non-food products and further can be used for mixing, microwave cooking and serving of food products therefrom.

Another object of the present invention is to provide a foldable carton which will automatically square itself up during the forming process so as to eliminate the need for indexing of tabs and to reduce the cycle time required to effect folding.

Still a further object of the present invention is to provide a foldable carton having an extension or skirt above the sidewalls which will reduce the chance of spatter during cooling with an open top and spilling of the contents when eating directly from the carton.

Another object of the present invention is to provide a foldable carton having an extension which enables the addition of ingredients to the carton and mixing prior to and during cooking.

Another object of the present invention is to provide a foldable, tray-like carton which is impervious to leakage of liquid contents therefrom during microwave cooking.

A further object of the present invention is to provide a foldable carton which can be used as a set-up carton that can be shipped flat and set-up by a merchant to be used as a container for the merchant's products.

Still a further object of the present invention is to provide a foldable carton which is less expensive to form, has improved strength and durability, and is easy to open and use.

The foldable carton of the present invention has other objects and features of advantage which will become apparent from and are set forth in more detail in the accompanying drawing and following description of the Best Mode Of Carrying Out The Invention.

DISCLOSURE OF INVENTION

The foldable carton of the present invention is formed from a one-piece blank of sheet material having a bottom panel, a side panel assembly foldably joined to and extending completely around the periphery of the bottom panel, and an extension panel assembly foldably joined to the outer periphery of the side panel assembly. The side panel assembly includes webs formed for folding of the side panels to an elevated position relative to the bottom panel to provide a seamless volume for the containment of food or other products, and the extension panels are foldably joined for folding to an inward position relative to the side panels.

The improvement in the carton of the present invention comprises, briefly, the extension panel assembly including extension webs connecting portions of the extension panels together as a continuous band completely encircling the outer periphery of the side panels, and relief openings formed in the blank between the side webs and extension webs and adapted for folding of the extension panels to an inward position. While the carton may have straight side walls, it is most preferably a tray-like carton formed with outwardly sloped side panels joined by folded webs at each corner, and having foldably joined thereto a plurality of pop-up extension panels or skirts which are connected at the ends thereof by foldable extension panel webs. The extension webs permit folding of the extension panels between a position parallel to and spaced above the bottom panel and an upright position extending above the side panels to provide access to the carton, to allow the addition of ingredients and mixing in the carton, and to prevent spillage during use as a serving dish. The container also preferably includes a top panel which includes one of the extension panels as an element of the top and is adhesively secured to an opposed extension panel. The top panel is reverse cut to permit removal while leaving one extension panel in place to pop-up to an extended position and leaving a portion of the top panel adhesively secured to the opposite extension panel for movement therewith.

BEST MODE OF CARRYING OUT THE INVENTION

The carton of the present invention may be constructed in a wide variety of sizes and shapes. Most preferably, however, it is of the same general size as frozen food cartons which are widely distributed through supermarkets and the like. The present carton is designed to enable storing virtually any product, but it is particularly well suited for storing of food products in a frozen or shelf-stable (dehydrated and/or chemically treated) state. Additionally, the carton of the present invention advantageously may be used for adding of ingredients, mixing and microwave or other heating or cooking of food products while contained in the carton with the carton being either open topped or closed. Finally, the carton of the present invention is constructed to facilitate its use as a serving dish so that the user may consume the food product directly from the carton.

Figure 1:
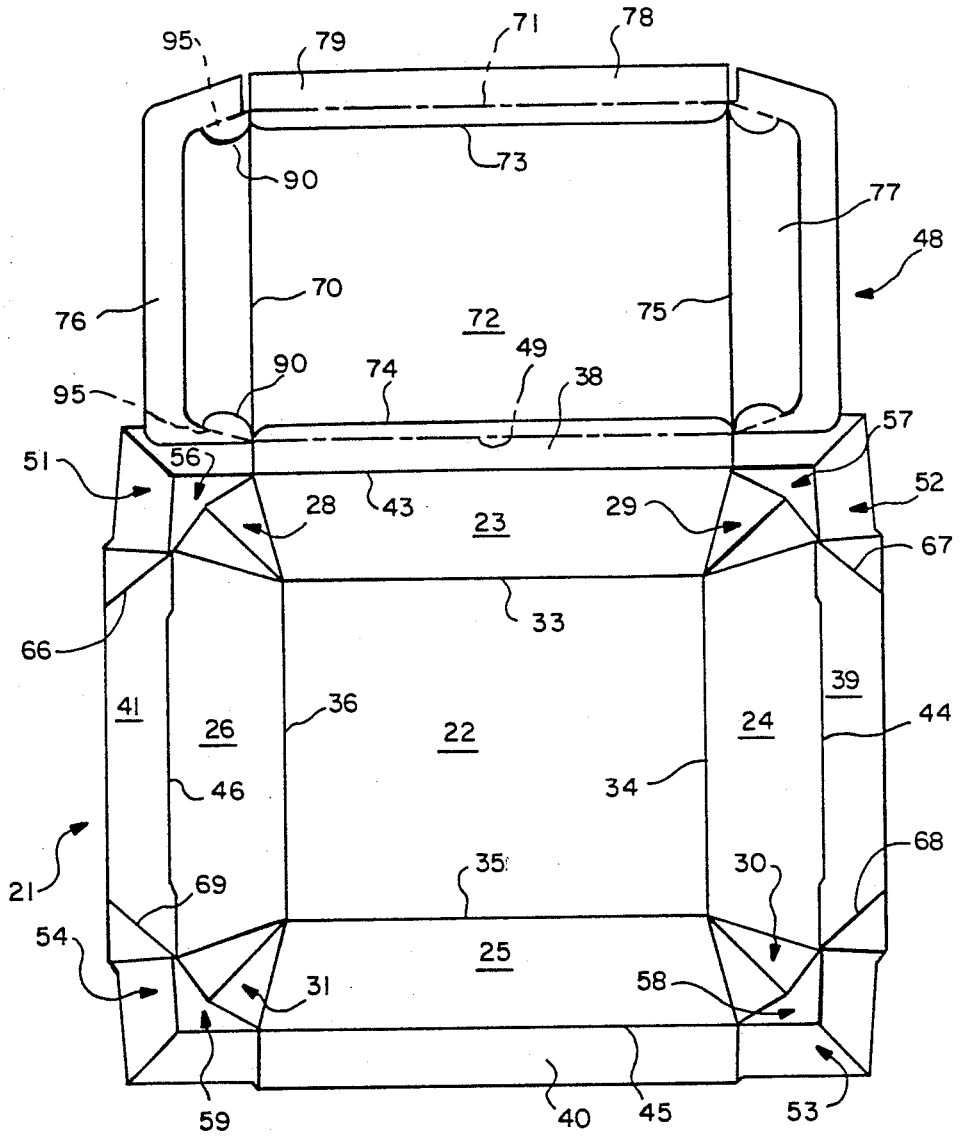
FIG. 1 is a top plan view of a one-piece blank of sheet material suitable for formation of the foldable carton of the present invention.
Figure 8:
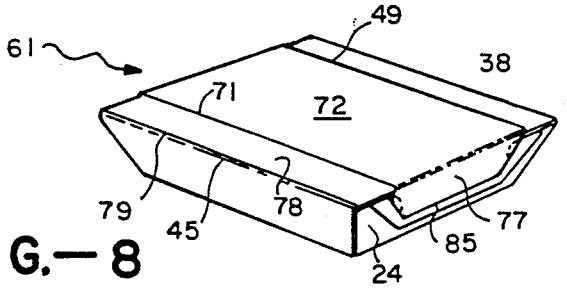

A one-piece blank of sheet material suitable for forming the carton of the present invention is shown in FIG. 1, while the folded resulting tray-like carton is shown in FIG. 8. It is an important aspect of the present carton that it may be formed from a one-piece carton blank. Thus, a carton blank, generally designated 21, includes a bottom panel 22 which is here shown to have a polygonal, i.e. rectangular, shape. It will be understood, however, that in the broadest aspect, bottom panel 22 may have a curvilinear outer periphery or edge.

Foldably mounted to bottom panel 22 is side panel means. As shown in FIG. 1, the side panel means is comprised of two side panels 23 and 25 and two end panels 24 and 26, as well as four side web assemblies 28, 29, 30 and 31. Together, side and end panels 23–26 and side web assemblies 28–31 extend completely around the periphery of bottom panel 22. When foldable carton blank 21 is formed of a paperboard material, as is common for frozen food packages, fold lines 33, 34, 35 and 36 can be rolled into the paperboard stock in a conventional manner.

In order to provide additional height to the carton for the convenience of adding ingredients, mixing the contents, cooking without spatter and eating directly therefrom, carton blank 21 further includes an extension panel means foldably joined to the outer periphery of the side panel means. As shown in FIG. 1, the extension panel means is comprised of two side extension panels 38 and 40 and two end extension panels 39 and 41. Extension panels 38–41 are foldably joined to side and end panels 23–26 along fold lines 43, 44, 45 and 46.

Additionally, it is preferable that the carton include a top panel assembly, generally designated 48, which is joined to one of the extension panels, in this case to side extension panel 38.

As thus far described, the foldable carton of the present invention includes panel components or portions which are generally found in prior art foldable cartons, for example, in U.S. Pat. No. 4,586,648.

In the foldable carton of the present invention, however, several important features are provided that are not found in the prior art. First, the present foldable carton is formed so that it automatically squares itself up during the forming or folding process, which permits rapid folding without the need for holding of carton flaps in place to adhesively secure the same. Second, the extension portion of the carton can be folded to a position parallel to the bottom panel and then snapped or popped open to a near vertical position to permit adding of ingredients, mixing, spatter-free cooking and easy access to the contents of the carton. Third, the side extension panel of the carton also functions as a portion of the carton top or closure assembly, and additionally, the carton may be used as a set-up carton.

The first feature is accomplished by forming carton blank 21 with extension means which includes extension web means or extension assemblies 51, 52, 53 and 54 which are foldably connected to end edges of extension panels 38–41 so as to couple the extension panels together in a continuous band which completely encircles the outer periphery of the side panel means. As will be seen from FIG. 1, webs 51–54 and side and end extension panels 38–41 form a complete circle which surrounds the side and end panels.

The provision of carton extension means as a continuous band necessarily results in the extension, and the side and end panels folding in a square or aligned relationship, since there are no free tabs or ends on the extension panels that can become skewed or misaligned during the folding process.

In order to enable the extension portion of the carton to be a continuous band and further to fold inwardly relative to the side and end panels 23–26, carton blank 21 is further formed with relief opening means positioned between side web assemblies 28–31 and extension web assemblies 51–54. As shown in FIG. 1, four relief openings 56, 57, 58 and 59 are provided at the corners of the carton. These openings remove sufficient material from the carton blank at the critical corners, where multiple layers of material would otherwise occur, which layers would prevent compact folding of the corners. Moreover, it is important to note that openings 56–59 in carton blank 21 are provided at locations at about the top edges of the side and end panels so that they are positioned to resist possible leakage from the carton. As will be seen and described in more detail, the side webs 28–31 foldably join the side panels to the end panels and to bottom panel 22. Thus, the corners of the carton and bottom edges are all water impervious, and when the sides are folded to an inwardly inclined position from bottom panel 22, the carton acts as a tray which can be used to cook foods containing substantial liquids. Thus, the relief openings 56–59 are above the level at which liquids normally would be positioned in the carton. It should be noted that when frozen or shelf-stable, the cartons can be stored on an end, but leakage of the food product from the carton will not occur when in a frozen or shelf-stable state.

Figure 3:
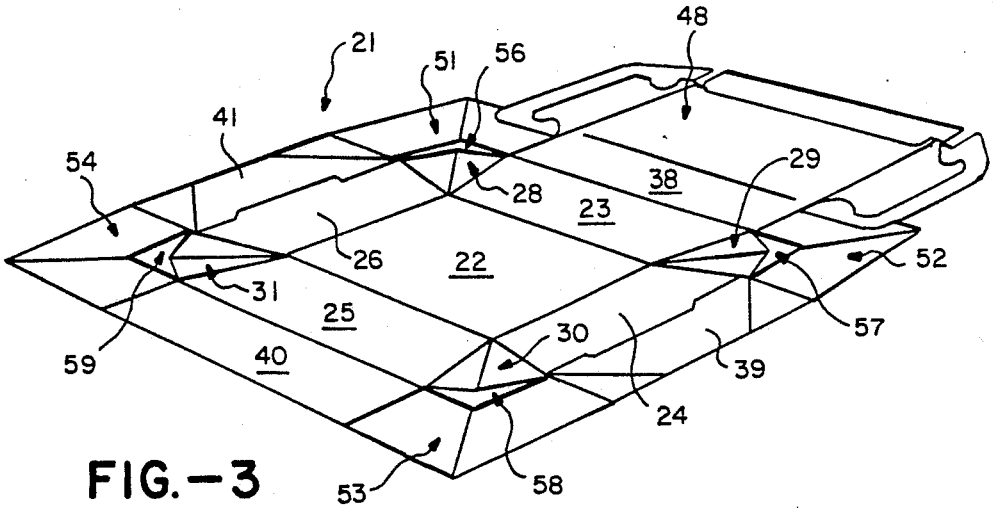
FIGS. 3 through 8 are top perspective views, in reduced scale, of the carton blank of FIG. 1 as it is progressively folded to form the tray-shaped carton of FIG. 8.
Figure 4:
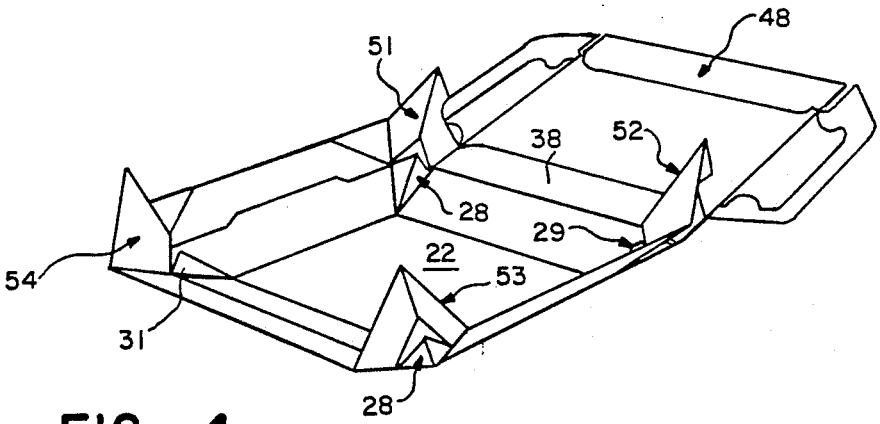
Figure 5:
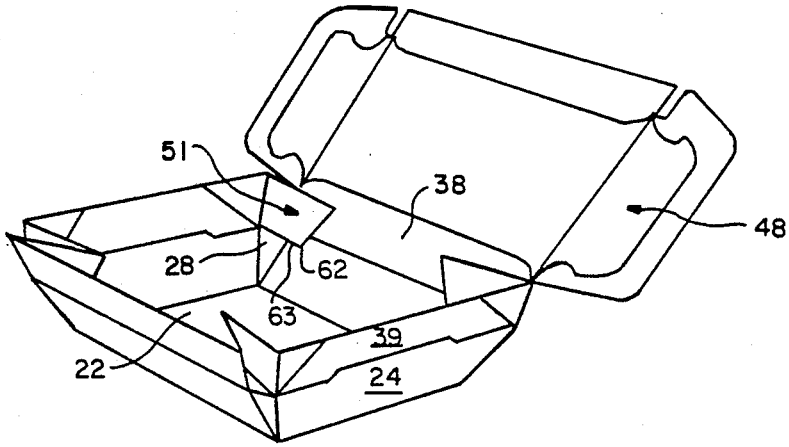

Folding of carton blank 21 to produce the finished carton 61 of FIG. 8 can now be described by reference to FIGS. 3–8. FIG. 3 shows the carton of FIG. 1 in a top perspective view. In FIG. 4, side web assemblies 28–31 have been folded toward the interior of the carton, as have extension web assemblies 51–54. This has the result of elevating both the side and end panels, as well as all of the extension panels to a position inclined with respect to bottom panel 22. FIG. 5 shows the web folding process in a further advance stage, and it will be noted that the lower front edges 62 of extension web assembly 51 is advanced inwardly farther than the upper corner 63 of side web assembly 28. A similar inward displacement occurs at each of the web assemblies in the corner of the carton. This displacement is the result of the side panels 23–26 being folded to an upwardly inclined position with respect to bottom panel 22 which is less than 90 degrees, while the skirt panel means is folded to a position which is inclined at a different angle, in this case, approximately 90 degrees from bottom panel 22. This gives the carton of the present invention tray-like structure which is desired with an upward extension that is near vertical above the upwardly and outwardly inclined side and end panels.

If desired, it will be understood, however, that the extension means and the side and end panels can be inclined at the same angle, for example, at 90 degrees to bottom panel 22, as is shown for the carton of FIGS. 11–15. Such a construction is dependent upon the configuration of the fold lines, as will be described in more detail hereinafter in connection with FIG. 2. One of the advantages of the use of corner relief openings 56–59, however, is that they permit the extension and the side and end walls of the carton to be inclined at different angles with respect to the bottom panel since they will accommodate the shifting of the edges 62 and 63, which would not be accommodated if the carton blank were unrelieved.

Figure 6:
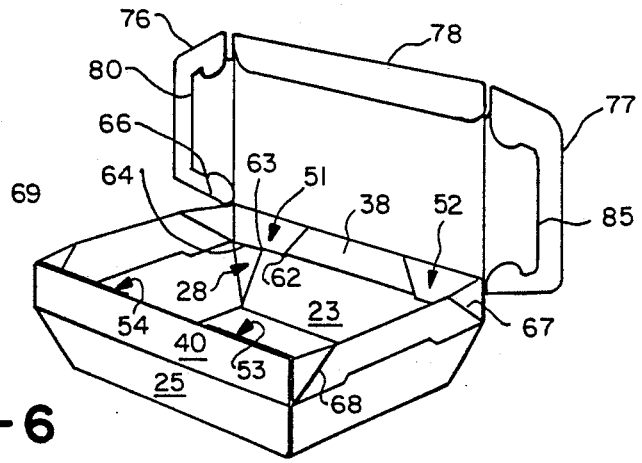

FIG. 6 shows the carton as it is formed and ready for filling with the food product. Side web assembly 28 has been folded inwardly and adhesively secured to side panel 23. Similarly, extension web assembly 51 has been folded inwardly and adhesively secured to side extension panel 38. The opening has essentially become folded against the side of the carton and is a space 64 extending between the lower edge of web 51 and the upper edge of web 28 (which space 64 also may be seen in FIG. 10). Each of the extension webs and side webs are similarly folded and adhesively secured to corresponding carton panels. Thus, as shown in FIG. 6, the carton is ready to receive food product, which is placed in the carton up to the upper edge of the side and end panels.

It should be noted, however, that extension web 51 is positioned in sufficiently close relation to side web 28 (that is space 64 is relatively small—4 times the material caliper) that the side web will provide support for the extension web in the event that the container corner should be loaded. Thus, the web 28 and web 51 provide a corner reinforcing structure which is highly effective in resisting crushing of the carton.

Figure 7:
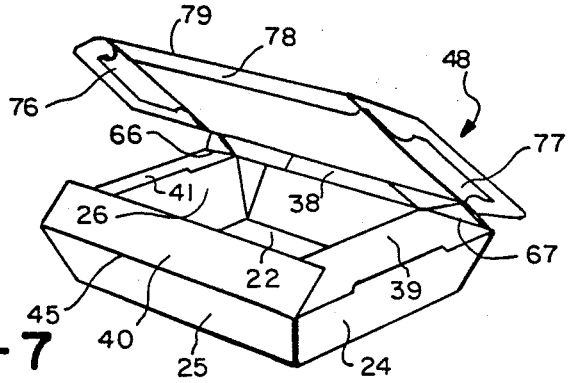

Once the carton is filled, it may be closed. In FIG. 7, extension walls 38–41 have been partially inwardly folded. This is accomplished by forming the extension web assemblies with fold lines 66, 67, 68 and 69 in end extension panels 39 and 41. These fold lines are best seen in FIGS. 1 and 6, and if the end extension panels are folded inwardly along fold lines 66–69 all four extension panels 38–41 will collapse to a position substantially parallel to the bottom panel 22, which, in turn, draws lid assembly 48 downwardly over the top of the carton, since side extension panel 38 and top panel portion 72 are in the same plain.

In the broadest form of the invention, it will be understood that extension panels 38–41 can have sufficient length so as to form a closure over the upper opening of the carton. Thus, top panel assembly 48 is optional in the broadest form of the carton of the present invention, and side and end extension panels 38–41 can form the top closure. Even in the form of the invention in FIG. 1, side extension panel 38 forms a part of the top closure assembly 48. The other extension panels 39–41 similarly extend partially over the open carton top.

It is preferable in the carton of the present invention, however, to provide a top assembly 48 which includes flaps and reverse cuts that allow easy removal of the carton top. Thus, as best may be seen in FIG. 1, top panel means 48 is preferably reverse cut (cut partially through) from the inside surface at lines 73 and 74. Additionally, the other half of the reverse cut of top panel portion 72 from the outside of the carton blank occurs along lines 71 and 49 (shown as phantom lines). Finally, the top carton assembly 48 includes end flaps 76 and 77, as well as side flap 78.

In order to fold top panel assembly 48 down over the open tray (along fold line 43), side flap 78 is adhesively secured to the outside surface of side extension panel 40. Thus, the edge 79 of side panel 78 is brought down to a position substantially superimposed over fold line 45 between side extension panel 40 and side panel 25. End flaps 76 and 77 are folded along fold lines 70 and 75, respectively, down over end panels 24 and 26 and adhesively secured thereto. The result is the sealed carton 61 of FIG. 8.

Figure 9:
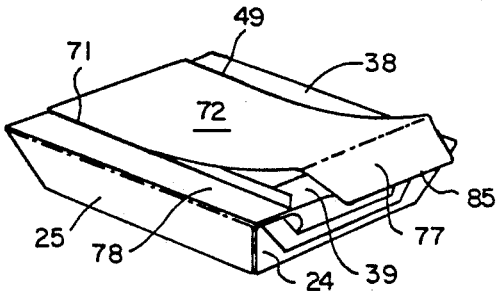
FIG. 9 is a top perspective view corresponding to FIG. 8 with the top of the carton partially opened.
Figure 10:
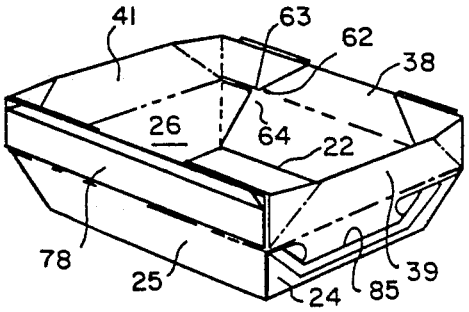
FIG. 10 is a top perspective view of the carton with the top removed and the extension panels folded up to a deployed position.

Opening of the carton and use of the same by the consumer can best be understood by reference to FIGS. 9 and 10. The user can defrost and/or add water or other ingredients to the carton and heat the said in a microwave oven. Since the heating process often will result in expansion and the generation of gases, it is preferably that one of end flaps 76 and 77 be lifted as shown in FIG. 9. Most preferably flaps 76 and 77 are die cut completely through the blank at score lines 80 and 85. Reverse cut lines 90 (from the inside) and 95 (from the outside) allow the user to grip the flaps at edges 80 and 85 and pull the flaps inside the adhesive upwardly as shown in FIG. 9.

Once microwave cooking is complete, flap 77 or flap 76 can be pulled across the top of the carton so as to pull the top panel 72 off the carton by separating the said along the reverse cut lines 71/73 and 49/74. The section or side flap 78 remains adhesively secured on top of side extension panel 40, but once top assembly strip comprised of end flap 77, central portion 72 and end flap 76 is pulled off the top of the carton, the extension assembly can be popped or unfolded to the upright position shown in FIG. 10. As seen in FIG. 10, the extension assembly on the upper edge of the sidewalls of the carton not only provides easy access to the entire interior of the carton, but it supplies a skirt or extension which will resist spattering if cooking is done with an open tray top. Moreover, the tray extension allows the addition and mixing of ingredients prior to cooking.

Figure 2:
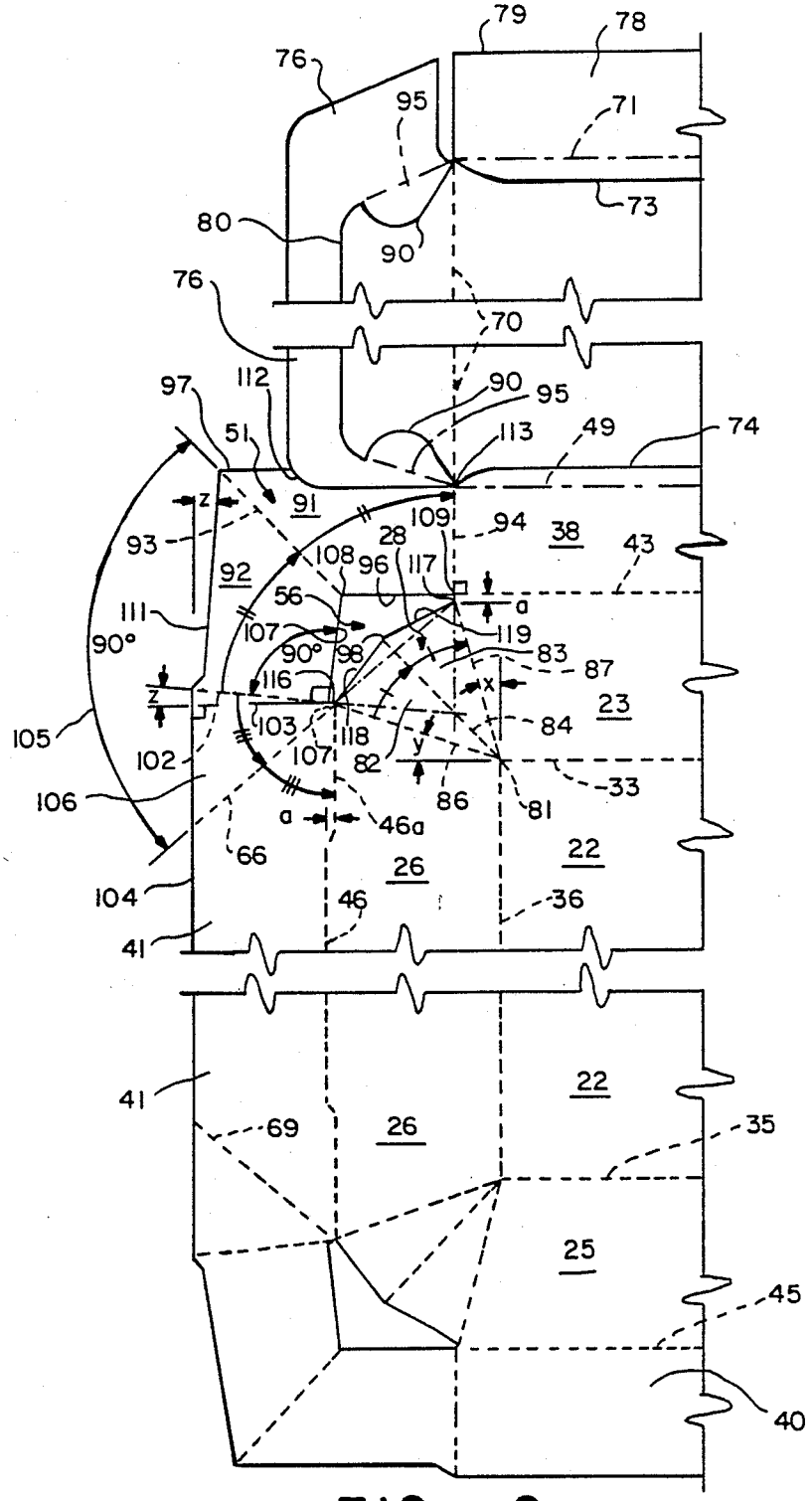
FIG. 2 is an enlarged, fragmentary top plan view of the left hand side and corner detail of the carton blank of FIG. 1.

Further details of the construction of the foldable carton of the present invention can be best understood by reference to FIG. 2. More particularly, the location and geometry of the fold lines (shown as dotted lines) and corner relief openings can be described.

As set forth above, side panel 23 and end panel 26 are foldably joined to bottom panel 22 along fold lines 33 and 36, respectively. Fold lines 33 and 36 meet at a common apex 81 with side web assembly 28. As will be seen, side web assembly 28 is comprised of two triangular web portions, namely, triangular web portion 82 and triangular web portion 83. Triangular web portions 82 and 83 are joined along a common fold line 84 which is halfway between fold lines 86 and 87, which, in turn, join the web portions to the end and side panels, respectively. Fold line 87 can be seen from FIG. 2 to be inclined by an angle x from an extension of fold line 36, the edge of bottom panel 22. The angle x determines the draft angle of end wall 26.

Similarly, the fold line 86 between end panel 26 and side web portion 82 is at an angle y to the extension of fold line 33. The angle y determines the draft angle of side wall 23. It is preferable, but not imperative, that both side wall 23 and end wall 26 be folded to an inclined position with respect to the bottom panel which is less than 90 degrees, as measured from the outside of the carton. If the carton walls slope slightly outwardly from vertical planes through fold lines 33 and 36, it is easier to remove the forming mandrel from the interior of the carton. As will be understood by those skilled in the art, however, it is also possible for the side and end walls to be vertical or even have a negative draft with respect to the interior of the carton if a forming mandrel is employed that includes retractable slide plates. Such mandrels, however, are somewhat more expensive and require additional cycle time. Accordingly, it is preferable that the sidewalls have a draft outwardly which will permit easy withdrawal of the forming mandrel.

The carton of the present invention can be constructed such that the angle x is equal to or different from the angle y. Thus cartons may be formed which have, for example, an angle y which is 25 degrees with an angle x that is 5 degrees. This will cause the sides 24 and 26 to be nearly vertically oriented while the ends 23 and 25 are more sloped and tray-like. Such a carton is particularly useful for frozen foods or shelf-stable foods which are displayed in upright freezer or display cases, as is becoming more common in supermarkets.

Since a common fold line 84 is equidistant between fold lines 86 and 87, web portions 82 and 83 are identical in shape.

The geometry of extension web assembly 51 can now be set forth. The extension web assembly is comprised of two trapezoidal web portions 91 and 92 which are joined along a common fold line 93, which can be seen to be an extension of fold line 84 in the side web assembly 28. The fold line 94 joins extension web portion 91 to side extension panel 38 and is formed at right angles to the fold line 43 between side panel 23 and side extension panel 38.

Fold line 66 is formed as a right angle from central fold line 93, as indicated by arrows 105. Fold line 102 will be positioned at an angle z from a perpendicular line 103 to outer edge 104 of end extension panel 41. The angle z is equal to the difference between the angle y minus the angle x. Thus, fold line 102 is rotated by the difference between the two draft angles y and x. The triangular extension web portion 106, therefore, is defined by fold lines 66 and 102, as well as outer edge 104 of the carton. The apex 107 is at the corner of triangular side web portion 82. As will be seen from FIG. 2, the angle between fold line 66 and fold line 102 is the same as the angle between fold line 66 and stepped fold line 46*a*.

The inner edge 107 of trapezoidal extension web portion 92 is positioned at right angles to fold line 102. Inner edge 106 extends from fold line 102 to fold line 93. The inner edge 96 of trapezoidal extension web portion 91 extends from the inner section 108 of edge 107 with fold line 93 to apex 109, which is the intersection of fold line 43 and fold line 94. The outer edge 111 of trapezoidal extension web portion 92 is parallel to inner edge 107.

The outer edge 97 of skirt trapezoid segment 91 is parallel to the inner edge 96 and extends to the edge 112 of end flap 76. The edge 97 is die cut to apex 113, which is at the end of reverse cut lines 49 and 74 and fold line 94.

As will be seen in FIG. 2, opening 56 is defined by short segments 116 and 117 which are spaced by a distance, "a," from fold line 46 and fold line 43, respectively. The segment 116 is an extension of fold line 102 and the segment 117 is an extension of fold line 94. The distance, "a," is equal to four times the thickness of the paperboard or sheet stock. Additionally, in order to accommodate the plurality of carton stock thicknesses when the side extension panel 38 folds down on top of end extension panel 41, fold line 46 is also stepped at 46*a* by a distance, "a." The outer edges 118 and 119 of the triangular side web portions 82 and 83 are straight lines from apex 98 to the inner ends of segments 116 and 117. It is possible to form inner edge 118 and 119 with an apex 98 that is less than the height of the side panels, namely, the distance between apex 98 and apex 81, but it is not possible to have the apex 98 positioned a significant distance farther away from apex 81 without interfering undesirably with carton folding.

Using the geometry above described, a wide variety of sidewall drafts and skirt configurations can be achieved. If the angles x and y are zero degrees, the opening 56 will reduce itself to a chevron-shape in which each of the legs in the opening have a thickness of the distance, "a." This will permit the necessary folding of the carton with side walls which are vertical and a skirt wall which folds between a horizontal and a vertical position. Such a carton is shown in FIGS. 11 through 15.

It is preferable that the foldable carton of the present invention be formed of a paperboard or fiberboard material of the type conventionally used for frozen food products. It will be understood, however, that the principles of employing a continuous web with relieved corners can be applied to plastic sheet material as well. It is further preferred that the carton be formed as a rectangular carton, but hexagonal, octagonal and even cylindrical or curvilinear cartons are thought to be suitable shapes for utilization of the carton construction of the present invention.

One advantage of the present carton is that the resulting carton is very rigid, particularly in the corners. This construction can be used with an insert to form a heavy walled carton that is printed, for example, with four color printing. Thus, carton blank 21 can be 24 point paper board which can be run through a conventional printing press. A corrugated insert, having the same shape as bottom panel 22, side panels 23 and 25, and end panels 24 and 26, but slightly smaller dimensions can be used as an insert into the folded carton. The insert would not have side web assemblies, and it would be trapped in position inside the carton and against the bottom and sides when the extension panels are folded to a position parallel to bottom panel 22.

A carton according to the present invention which is suitable for use as a set-up carton is shown in FIGS. 11–15. A set-up carton is a carton that comes to the product merchandiser in a folded, but flat, condition. The merchandiser can open the folded carton to a position allowing product to be placed in the carton and then close the top of the carton so that the consumer may carry the product in the carton. Set-up cartons must unfold or open for filling and thereafter close with the product inside using minimal amount of carton manipulation so as to be suitable for use by salesmen or clerks without any tools.

Figure 11:
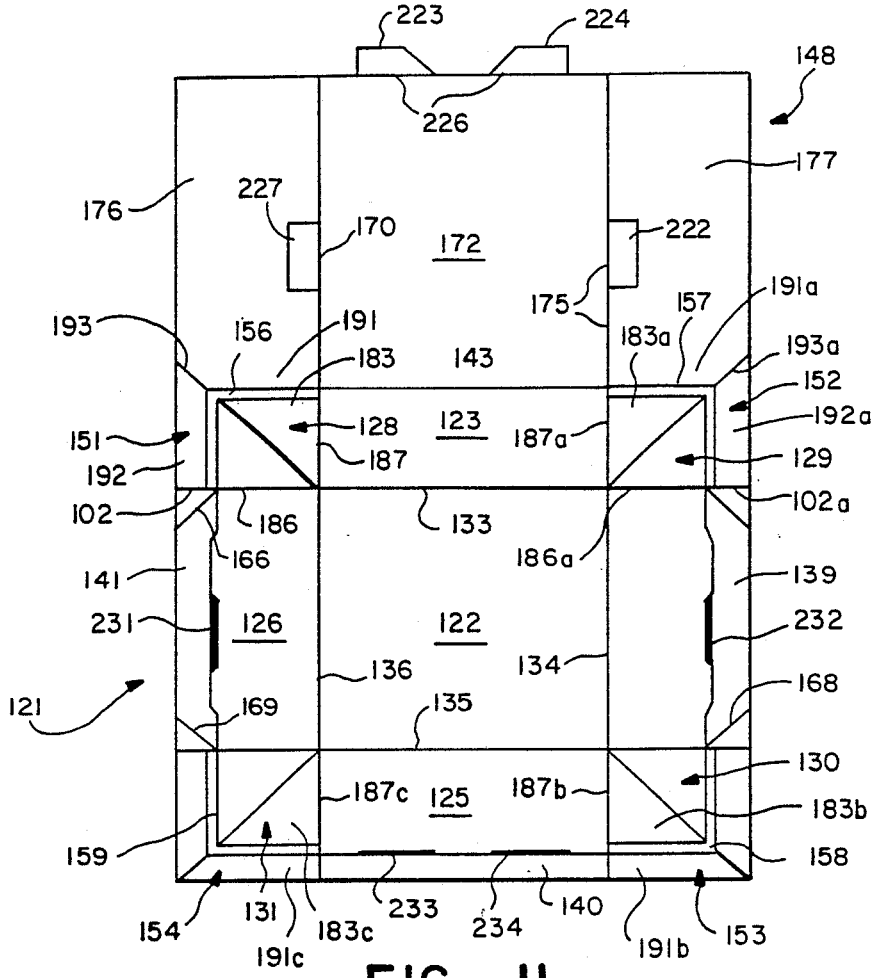
FIG. 11 is a top plan view of an alternative embodiment of a one-piece blank carton blank of the present invention which is suitable for formation of a foldable set-up carton.

FIG. 11 shows a one-piece carton blank 121 having a bottom panel 122, a pair of side panels 123 and 125, and a pair of end panels 124 and 126. The side and end panels are connected by web assemblies 128–131, and extension panels 139–141 are foldably secured to the side and end panels in a manner similar to carton 21. In the set-up carton blank 121, side panel 38 does not have an equivalent and is merely included as a part of top panel 172.

As was the case for carton 21, the extension panels are connected by extension webs 151–154, and the corners of the carton between side webs 128–131 and extension webs 151–154 are relieved or formed with chevron-shaped openings 156–159 each having a height dimension equal to four times "a," the caliper of the carton blank.

In the carton of FIG. 11, top assembly 148 includes top panel 172 and end flap panels 176 and 177 joined thereto by fold lines 170 and 175, respectively. Also provided on blank 121 are a pair of end tabs 221 and 222 which are die cut through the stock except at fold lines 170 and 175. Additionally, side tabs 223 and 224 are joined by a fold line 226 to top panel 172. Dimensioned to receive end tabs 221 and 222 are die cuts or slots 231 and 232, while slots or die cuts 233 and 234 receive side tabs 223 and 224 in a manner which will be described more fully below.

Figure 12:
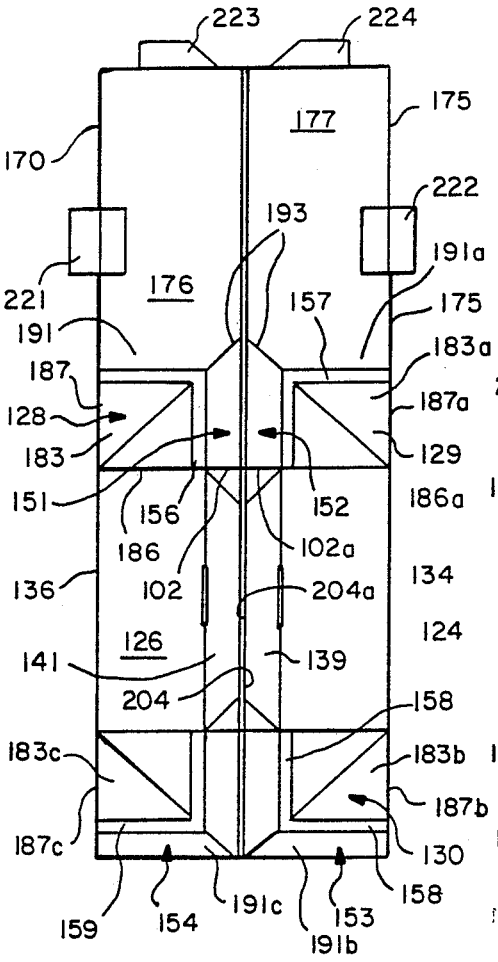
FIG. 12 is a top plan view of the carton blank of FIG. 11 in an intermediate stage of folding.

Folding of the carton and adhesive securement of selected web portions for shipment to merchandisers in a flat-folded condition can be described by reference to FIG. 12. FIG. 12 shows the blank folded along aligned fold lines 175, 187*a*, 134 and 187*b* on the right side of the carton and aligned fold lines 170, 187, 136 and 187*c* on the left side of the carton.

In order to facilitate quick set-up certain of the carton panels are adhesively secured to each other at the factory in the folded state of FIG. 12. Thus, panels 176 and 177 are adhesively secured to top panel 172, except there should be no adhesive outside of fold lines 193 and 193*a* or under tabs 221 and 222.

Additionally, triangular side web panels 183 and 183*a* are adhesively secured to end panel 123 and triangular side web panel 183*b* and 183*c* are both adhesively secured to side panel 125. Moreover, extension web portions 191 and 191*a* (immediately above openings 156 and 157) are adhesively secured to top panel 172 and extension web portions 191*b* and 191*c* are adhesively secured to extension 140. Carton blanks can be shipped to the merchandiser as shown in FIG. 12. As will be appreciated, a stack of folded-flat cartons will be very compact.

When the merchandising organization receives the folded-flat cartons, they can be easily set-up into cartons which will receive product and can be closed easily thereafter.

Figure 13:
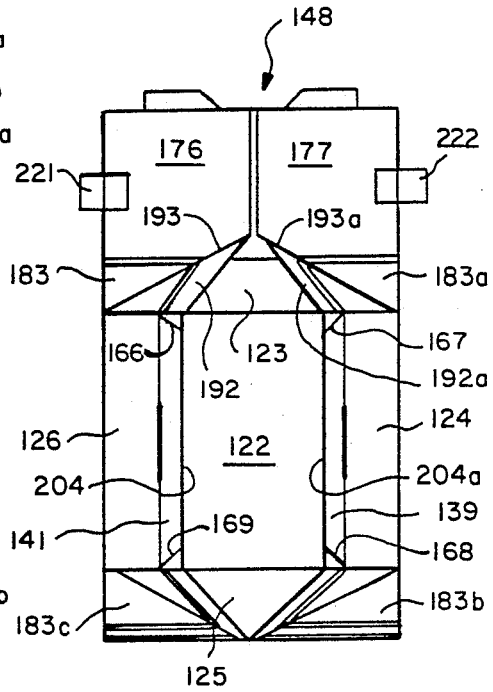
FIG. 13 is a top plan view of the carton blank of FIG. 11 in a partially opened condition.

The user can then grip the top edges 204 and 204*a* of the end extension panels 141 and 139, respectively and fold end panels 124 and 126 to a vertical condition. FIG. 13 shows the end panels and end extensions unfolded to approximately a 45 degree condition. As the end panels and extensions are folded away from each other, the side panels 123 and 125 are folded upwardly toward each other. Side panel 123 carries top assembly 148 up with it. Adhesive securement of triangular web panels 183, 183*a*, 183*b* and 183*c* and extension webs 191, 191*a*, 191*b* and 191*c* results in the simultaneous inward folding of side panels 123 and 125 about fold lines 133 and 135, as the end panels 124 and 126 are outwardly folded about fold lines 134 and 136.

Figure 14:
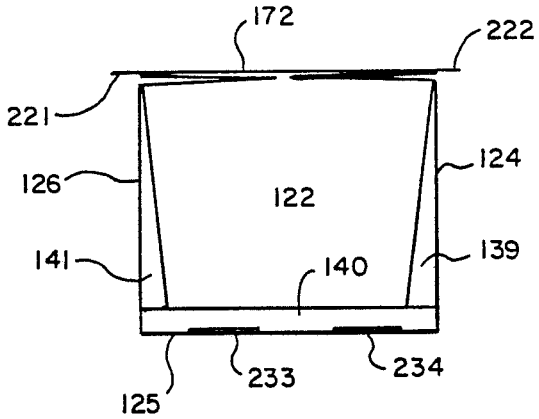
FIG. 14 is a top plan view of the carton blank of FIG. 11 in an opened condition suitable for the receipt of product.

FIG. 14 shows a top view of the carton when the side and end walls have to be unfolded or set-up to a vertical position with respect to bottom panel 122. Additionally, extension panels 139, 140 and 141 have been folded by 90 degrees inwardly of the end and side walls to extend parallel to bottom panel 122. In order to accommodate such extension panel folding, the extension web assemblies include diagonal fold lines 166–169 (FIGS. 11 and 13). Moreover, fold lines 193 and 193*a* allow extension web portions 192*a* to be folded back against top flaps 176 and 177, respectively.

As is the case for carton 21, relieving the corners of carton 121 at openings 156–159 provides relief at the corners of the carton at which multiple folds occur.

Figure 15:
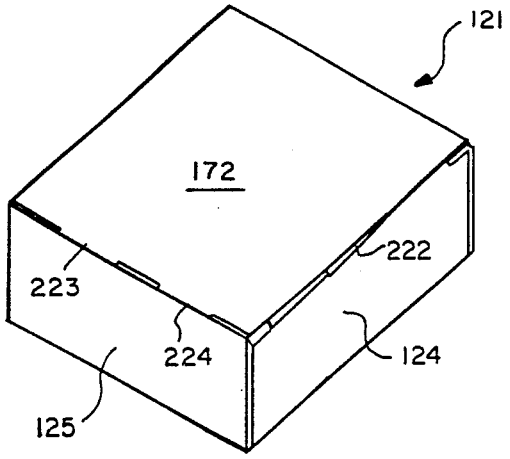
FIG. 15 is a top perspective view of a carton constructed from the carton blank of FIG. 11.

FIG. 15 shows the assembled carton with top panel 172 folded along fold line 143 to the closed position. Tabs 221 and 222 are inserted in slots 231 and 232, while tabs 223 and 224 are inserted in slots 233 and 234. The result is a carton which can be quickly and easily set-up and yet has substantial strength as a result of the corner web assemblies. Moreover, the cost of manufacturing such a carton is significantly reduced as compared to other carton configurations.

What is claimed is:

1. In a foldable carton formed from a one-piece sheet-like blank and having a bottom panel; side panel means foldably joined to and extending completely around the periphery of said bottom panel, said side panel means including side web means formed for folding of said side panel means to an elevated position relative to said bottom panel to provide a seamless volume; and extension panel means foldably joined to an outer periphery of said side panel means for folding to an inward position relative to said side panel means; the improvement in said carton comprising:

said extension panel means includes extension web means connecting portions of said extension panel means together as a continuous band completely encircling said outer periphery of said side panel means; and relief opening means formed in said blank between said side web means and said extension web means and adapted for folding of said extension panel means to said inward position.

2. The foldable carton as defined in claim 1 wherein, said relief opening means is adapted for folding of said extension panel means to an inward position substantially parallel to said bottom panel.

3. The foldable carton as defined in claim 1 wherein, said side web means is provided by a plurality of side webs each formed by two planar side web portions foldably joined together along a common edge and foldably joined to two side panels at opposite edges; and said extension web means is provided by a plurality of extension webs each formed by three planar extension web portions foldably joined together along two common intermediate edges and foldably joined to two extension panels at opposite edges.

4. The foldable carton as defined in claim 3 wherein, said common, edge between said side web portions and said common edge between said extension web portions are substantially aligned.

5. The foldable carton as defined in claim 3 wherein, said side web portions are triangular in shape; and said extension web portions outwardly of and aligned with said side web portions are substantially trapezoidal in shape.

6. The foldable carton as defined in claim 1 wherein, said relief opening means is formed for selective folding of said extension panel means between said inward position and a vertically extending position extending the height of said side panel means above said bottom panel.

7. The foldable carton as defined in claim 1 wherein, said bottom panel is a polygon;

said side panel means is formed by a plurality of planar side panels foldably joined together at ends thereof by said side web means;

said extension panel means is formed by a plurality of planar extension panels equal in number to said side panels and foldably joined together by said extension web means; and said side web means and said extension web means are aligned with each other.

8. The foldable carton as defined in claim 1 wherein, said relief opening means is provided by an opening between each of said side web means and said extension web means having a dimension in a direction extending away from said bottom panel of at least equal to four times the thickness dimension of said blank.

9. The foldable carton as defined in claim 1 wherein, said side panel means includes a pair of opposed polygonal side panels and a pair of opposed polygonal end panels, and said side web means is provided by a plurality of side webs formed by polygonal side web portions, said side web portions being foldably joined to each other and foldably joining said side panels to said end panels, and said side web portions terminating in upper edges defining a portion of said relief opening means, said side web portions extending and having a dimension between said bottom panel and said edges not substantially greater than the height dimension of said side panels.

10. The foldable carton as defined in claim 9 wherein, said side web portions have a dimension which is less than said height dimension of said side panels by about four times the thickness dimension of said carton.

11. The foldable carton as defined in claim 1 wherein, said extension panel means includes a pair of opposed polygonal side extension panels and a pair of opposed polygonal end extension panels, and said extension web means includes a plurality of polygonal extension web portions, said extension web portions foldably joined to each other and foldably joining said side extension panels to said end extension panels, and said extension web portions terminating in lower edges defining a portion of said relief opening means, said lower edges not extending substantially below a fold line between said extension panels and said side panel means.

12. The foldable carton as defined in claim 1, and top panel means foldably joined to said extension panel means and formed to extend across said carton in spaced relation to said bottom panel to enable closing of said carton.

13. The foldable carton as defined in claim 12 wherein, said top panel means includes a top panel, a top seal flap, and a pair of end seal flaps, said extension panel means includes a pair of opposed side extension panels, said top seal flap being secured to an outside surface of one of said side extension panels and the other of said side extension panels being connected directly to said top panel.

14. The foldable carton as defined in claim 13 wherein, said top seal flap is joined to said top panel by a pair of reverse cut lines, said other of said side extension panels is joined to said top panel by a pair of reverse cut lines, said end seal flaps are each foldably joined to said top panel and are adhesively secured to one of said extension panel means and said side panel means.

15. The foldable carton as defined in claim 14 wherein, said end seal flaps are adhesively secured to said side panel means.

16. In a foldable tray-like carton for storing, microwave cooking and serving of a food product, said carton being formed from a one-piece paperboard sheet having a polygonal bottom panel; a pair of opposed side panels and a pair of opposed end panels foldably joined to each edge of said bottom panel to extend completely around the periphery of said bottom panel; side web means foldably joining said side panels to said end panels in a continuous band and including fold lines positioned for folding of said side panels and end panels to an elevated position relative to said bottom panel to provide a liquid impervious tray; and a pair of opposed side extension panels foldably joined to an outer periphery of each of said side panels and a pair of opposed end extension panels foldably joined to an outer periphery of each of said end panels for folding to an inward position relative to said side panels and said end panels when said side panels and said end panels are elevated with respect to said bottom panel; the improvement in said carton comprising:

extension web means foldable connecting each of the side extension panels to said end extension panels and forming with said side extension panels and said end extension panels a continuous band completely encircling said outer periphery of said side panels and said end panels;

said side web means and said extension web means being substantially aligned and extending outwardly from each of the corners of said polygonal bottom panel; and said side web means and said extension web means defining an opening therebetween, said opening extending over substantially the entire length of the outer peripheral edge of said side web means.

17. The foldable tray-like carton as defined in claim 16 wherein, said polygonal bottom panel is a rectangle;

said carton includes four side web means, and four generally radially aligned extension web means and each aligned side web means and extension web means defines an opening therebetween.

18. The foldable tray-like carton as defined in claim 17 wherein, said side web means are each formed as a pair of triangular side web portions foldably joined to each other along a common central fold line and foldably joined to an adjacent side panel and an adjacent end panel along draft determining fold lines which converge toward and meet said central fold line at about a corner of said bottom panel for inward folding of said triangular web side portions to elevate said side panels and said end panels, said draft determining fold lines being inclined at an angle between an edge of said bottom panel, and said draft determining fold lines establishing the angle of draft of said side panels and said end panels in said elevated position.

19. The foldable tray-like carton as defined in claim 17 wherein, said extension web means are each formed as three web portions foldably joined together including a first trapezoidal extension web portion foldably joined along one edge to one of said side extension panels and foldably joined along a first common fold line at an opposite edge to a second trapezoidal extension web portion, said second trapezoidal extension web portion being foldably joined along a second common fold line at an edge opposite said first trapezoidal extension web portion to a triangular extension web portion, and said triangular extension web portion having an edge opposite said second trapezoidal extension web portion foldably connected to one of said end extension panels for folding of said extension web means inwardly along said first common fold line and inwardly along said edge between said triangular extension web portion and said one of said end extension panels.

20. The foldable tray-like carton as defined in claim 19 wherein, said side web means are each formed as a pair of triangular side web portions; and the lower edge of said first trapezoidal extension web portion and the lower edge of said second trapezoidal extension web portion and the upper edges of said triangular side web portions define substantially the entire periphery of said opening.

21. The foldable tray-like carton as defined in claim 16, and top panel means joined to one of said side panels and said end panels.

22. The foldable tray-like carton as defined in claim 21 wherein, said top panel means includes a top panel, a pair of opposed end seal flaps foldably joined to said top panel, and a top seal flap joined to said top panel, and said top panel is formed with reverse cut lines to permit opening of said carton by lifting one of said end seal flaps and tearing a central portion of said top panel along said reverse cut lines.

23. In a carton formed from a one-piece paperboard blank, said carton having a rectangular bottom panel, two side panels and two end panels foldably joined to the four edges of said bottom panel and upwardly elevated from said bottom panel, four side web assemblies foldably joining adjacent ends of said side panels to said end panels to form a continuous water impervious tray-like structure with said bottom panel, said four side web assemblies being folded to an interior of said carton and secured against said side panels; two side extension panels and two end extension panels foldably joined to said side panels and said end panels respectively, and folded inwardly from said side panels and end panels to a folded position substantially parallel to said bottom panel; the improvement in said carton comprising:

four extension web assemblies foldably joining adjacent ends of said side extension panels to said end extension panels form a continuous band around said carton, said extension web assemblies being folded to the interior of said carton and having one portion thereof secured to said side extension panels and another portion free to move to enable said side extension panels and said end extension panels to pop-up from said folded position to an elevated position over said side panels and said end panels; and relief openings at each corner of said carton positioned between said side web assemblies and said extension web assemblies and having an area sufficient to enable folding of said side extension panels and said end extension panels to said folded position.

* * * * *